US006905375B2

(12) United States Patent
Ikeda

(10) Patent No.: US 6,905,375 B2
(45) Date of Patent: Jun. 14, 2005

(54) TERMINAL BOARD HAVING A FIRST FASTENING MEMBER ACCOMMODATED IN A CHAMBER

(75) Inventor: Tomohiro Ikeda, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/653,933

(22) Filed: Sep. 4, 2003

(65) Prior Publication Data

US 2004/0214477 A1 Oct. 28, 2004

(30) Foreign Application Priority Data

Apr. 23, 2003 (JP) ..... P2003-118949

(51) Int. Cl.[7] ..... H01R 4/30
(52) U.S. Cl. ..... 439/801
(58) Field of Search ..... 439/801

(56) References Cited

U.S. PATENT DOCUMENTS 5,772,479 A * 6/1998 Fleege et al. ..... 439/801

FOREIGN PATENT DOCUMENTS

JP 11-144783 A 5/1999
JP 2001-251089 A 9/2001

* cited by examiner

*Primary Examiner*—Phuong Dinh
(74) *Attorney, Agent, or Firm*—Sughrue Mion, PLLC

(57) ABSTRACT

In a terminal board, at which a first connecting member of a power feeding side and a second connecting member of a power receiving side are electrically connected, a board body is formed with a chamber and an opening continued from the chamber. A first fastening member has a contact portion, and is accommodated in the chamber to fasten the first connecting member and the second connecting member on the contact portion with a second fastening member along a fastening axis. The first fastening member is movable in the chamber in a first direction parallel to the fastening axis, so that the contact portion is projected from the opening in accordance with a fastening operation of the first connecting member and the second connecting member.

7 Claims, 9 Drawing Sheets

TERMINAL BOARD HAVING A FIRST FASTENING MEMBER ACCOMMODATED IN A CHAMBER

BACKGROUND OF THE INVENTION

The present invention relates to a terminal board, and more particularly, to a terminal board which is suitable for use with components or the like to which a motor power source of an electric vehicle is to be connected.

As a first related-art terminal board, Japanese Patent Publication No. 11-144783A discloses a terminal board which includes a board body formed of synthetic resin and a nut embedded in the board body by insert molding, to which two terminals superposed one on another is fixed with a bolt (cf., Pages 2–3 and FIG. 1).

As a second related-art terminal board, Japanese Patent Publication No. 2001-251089A discloses a terminal board which is provided inside a shield case made of aluminum die casting for connecting a terminal of a motor cable to a motor of an electric vehicle (cf., Pages 3–4 and FIG. 1).

In the first related-art terminal board, the nut is embedded by insert molding in such a manner that an upper end face of the nut is slightly projected from the terminal board. There is such a problem that in a case where the upper end face of the nut is not projected from the terminal board, the nut will be unable to establish an electric connection with the terminals, or alternatively, in a case where the upper end face is projected too much, a bonding length between the nut and the terminal board will be short, resulting in deterioration of bonding strength. The case has been the same, not only with the nut which has been fixed to the board body by insert molding, but also with the nut which has been fixed by heat pressure fitting or pressure fitting. A height of the nut with respect to the board body must be adjusted with high precision when manufactured, and it is a problem that high production cost would be required.

As shown in FIGS. 10 and 11, in the second related-art terminal board, a terminal board 30 in which a square nut 31 is embedded is fixed to a shield case 32 and mounted to a motor case 33. A bus bar 34 which is connected to a stator terminal 42 at its one end has a connecting portion 35 fixed to the other end which is faced with the terminal board 30. On the other hand, a terminal metal 38 fixed to a motor cable 36 is inserted into an insertion hole 39 of the shield case 32 which is provided at a side area of the terminal board 30 to be superposed on the connecting portion 35 of the bus bar 34, and they are fixed to the terminal board 30 with a bolt 40 which is screwed over the square nut 31. A waterproof rubber plug 41 inserted over the motor cable 36 is tightly fitted to an inlet of the insertion hole 39 to attain waterproof performance.

In a case where the square nut 31 which has been fixed to the terminal board 30 by insert molding, heat pressure fitting, pressure fitting, etc is projected from an upper face of the terminal board 30 as shown in FIG. 12, there is such a problem that the terminal metal 38 of the motor cable 36 which has been inserted through the insertion hole 39 at the side area may interfere with a side face of the square nut 31, and may result in deterioration of assembling workability or difficulty in assembling performance.

Moreover, in a case where the terminal metal 38 of the motor cable 36 which has been inserted through the insertion hole 39 is different in height from the square nut 31, and there is a gap C between them as shown in FIG. 13. In such a condition, there is such an anxiety that, when the terminal metal 38 is fastened to the square nut 31 with the bolt 40, the motor cable 36 may be inclined downward or bent as shown in FIG. 14, so that a gap C' will be created between the waterproof rubber plug 41 and the insertion part 39, thus badly affecting the waterproof performance. Under the circumstances, in order to prevent this phenomenon, it is necessary to manufacture the square nut 31 which has been fixed to the terminal board 30 and the insertion hole 39 with high precision so that they may have appropriate relative heights, and there is a problem that high production cost would be required.

Further, in a case where the connecting portion 35 is connected to a bus bar 51 which is provided on a connecting apparatus 50 as shown in FIG. 15, and a height H of the bus bar 51 is different from a height h of the square nut 31, there is such an anxiety that, when the bus bar 51 is fixed to the square nut 31 with the bolt 40, an undue force may be exerted on the bus bar 51 and the connecting apparatus 50 to render them distorted, so that the connecting apparatus 50 may be broken. In order to cope with these problems, it is necessary to take such countermeasures that the bus bar 51 and the terminal board 30 may be manufactured to have relative heights with high precision, or alternatively, the connecting apparatus 50 may be designed so as not to be distorted. In this case, however, not only the high production cost but also heavy weight and large outer dimension are additional problems.

SUMMARY OF THE INVENTION

It is therefore an object of the invention to provide a terminal board in which a difference in height between the terminal board and a connecting member can be absorbed if the difference exists, so that conductive members can be secured without distortion, whereby deterioration of waterproof performance due to the distortion and breakdown of components can be prevented, and assembling workability can be enhanced.

In order to achieve the above object, according to the invention, there is provided a terminal board, at which a first connecting member of a power feeding side and a second connecting member of a power receiving side are electrically connected, the terminal board comprising:

a board body, formed with a chamber and an opening continued from the chamber, and a first fastening member, having a contact portion, and accommodated in the chamber to fasten the first connecting member and the second connecting member on the contact portion with a second fastening member along a fastening axis, the first fastening member being movable in the chamber in a first direction parallel to the fastening axis, so that the contact portion is projected from the opening in accordance with a fastening operation of the first connecting member and the second connecting member.

With such a configuration, even though there is a difference in height between the first fastening member and the connecting members, the difference in height can be absorbed by the movement of the first fastening member in the first direction inside the chamber, so that the connecting members can be fastened in a state reliably contacted with the first fastening member. Accordingly, the conductive passage and connecting apparatuses will not be distorted nor affected by an undue force, and the connecting members can be secured to the terminal board without deterioration of waterproof performance and so on. Moreover, it will be unnecessary to reinforce against distortion, so that the terminal board and the connecting apparatuses can be made light weight and compact.

Here, it is preferable that: the first fastening member is formed with a projected portion extending in a second direction perpendicular to the fastening axis; the chamber is formed with a first retainer against which the projected portion abuts in a case where the first fastening member is located at a first end of the movement in the chamber, and a second retainer against which the projected portion abuts in a case where the first fastening member is located at a second end of the movement in the chamber; and wherein a distance in the first direction between the first retainer and the second retainer is larger than a thickness in the first direction of the projected portion.

It is further preferable that the contact portion is not projected from the opening in a case where the first fastening member abuts against the second retainer.

With such a configuration, because the first fastening member is accommodated in the chamber between the first retainer and the second retainer, the first fastening member will not fall from the chamber. Therefore, assembling workability of the connecting members can be remarkably enhanced, in cooperation with the advantage that the first fastening member is made movable in the fastening direction as described above.

Preferably, a projection projected from an inner face of the chamber in the second direction and extended in the first direction is abutted against the first fastening member.

With such a configuration, sounds of interference which occur when the first fastening member vibrates on occasion of driving a vehicle and interferes with the inner face of the chamber can be prevented. Further, decrease of fastening strength due to abnormal vibration of the fastening member will be prevented, so that a stabilized connection between the connecting members can be maintained for a long time period.

Preferably, the chamber has such a cross section in the second direction as to prevent the first fastening member from rotating in accordance with the fastening operation.

With such a configuration, the first fastening member can be moved in the first direction smoothly.

In the above configurations, the first fastening member is a nut member, and the second fastening member is a bolt member.

Alternatively, the first fastening member may be a bolt member, and the second fastening member may be a nut member.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with reference to the accompanying drawings.

Figure 1:
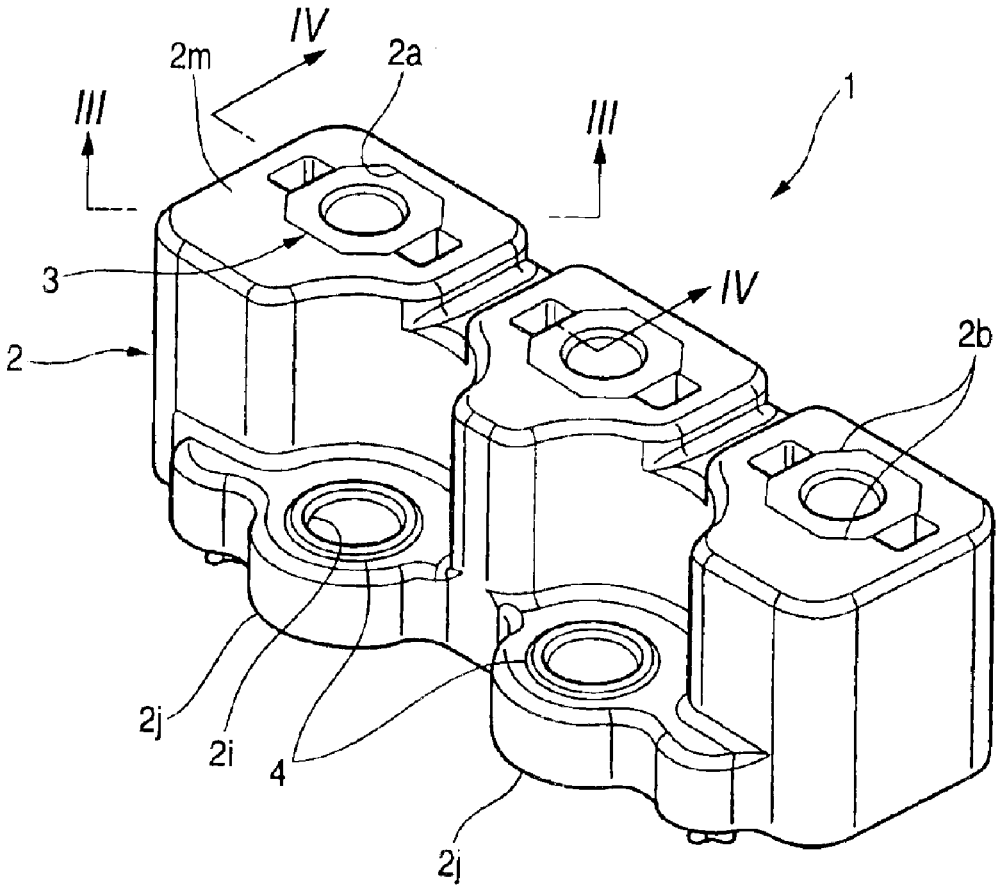
FIG. 1 is a perspective view of a terminal board according to a first embodiment of the invention.
Figure 2:
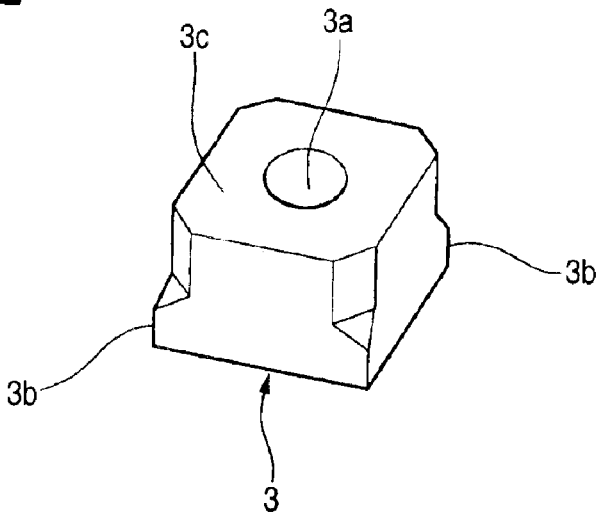
FIG. 2 is a perspective view of a square nut incorporated in the terminal board.
Figure 3:
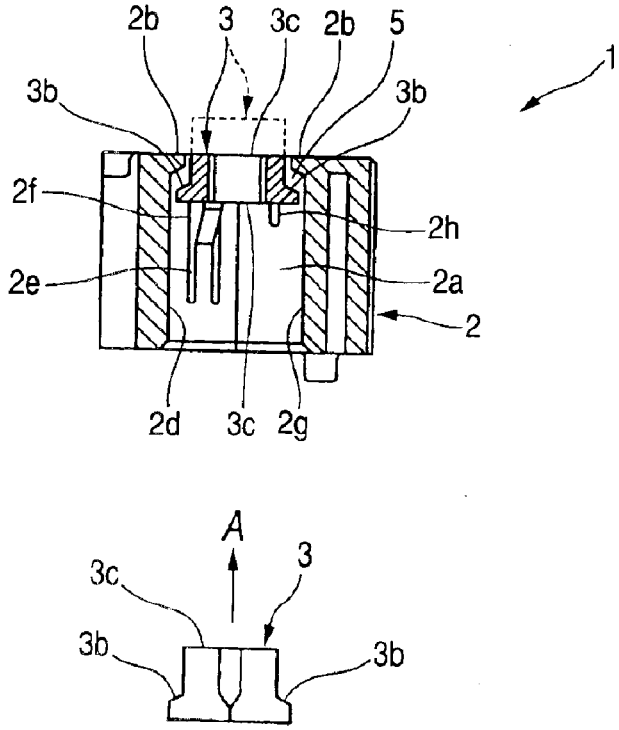
FIG. 3 is a vertical section view as seen in a direction of arrows III—III of FIG. 1.

As shown in FIGS. 1 to 3, a terminal board 1 comprises a board body 2 and a square nut 3. The board body 2 is formed of synthetic resin by injection molding into a roughly rectangular parallelepiped shape, and three nut chambers 2*a* are formed as through holes passing through the terminal board 2 in a vertical direction. In each of the nut chambers 2*a*, the hole is formed as a square-shaped hole slightly larger than the square nut 3 which will be described below, so that the square nut 3 can be inserted and accommodated therein. Moreover, as shown in FIG. 5, the nut chamber 2*a* is provided, at an upper end thereof, with retainers 2*b* so that the nut chamber 2*a* has a substantially octagonal shape at its upper end.

Figure 4:
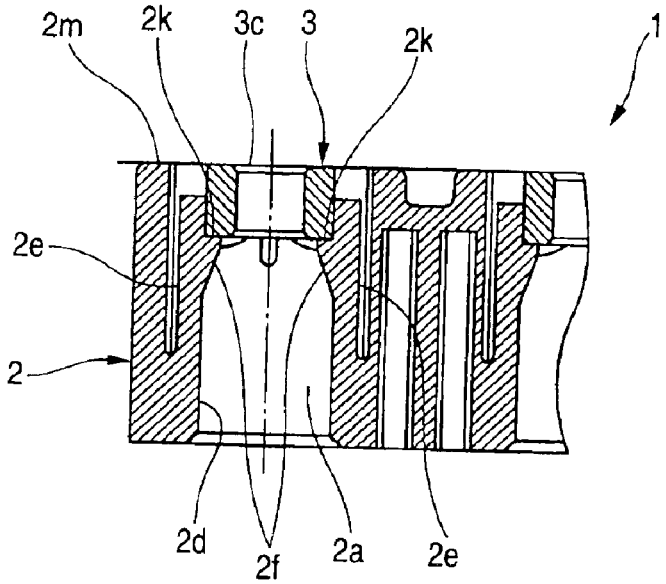
FIG. 4 is a vertical section view as seen in a direction of arrows IV—IV of FIG. 1.

As shown in FIGS. 3 and 4, a pair of lances 2*e* are formed in a cantilever manner on a pair of inner walls 2*d* of the nut chamber 2*a* which are opposed to each other. Each of upper free ends of the lances 2*e* are flexible in a width direction of the nut chamber 2*a*, and formed with an engaging projection 2*f* directed inwards of the nut chamber 2*a*. Upper ends of the engaging projections 2*f* are respectively formed as flat faces 2*k*

Figure 5:
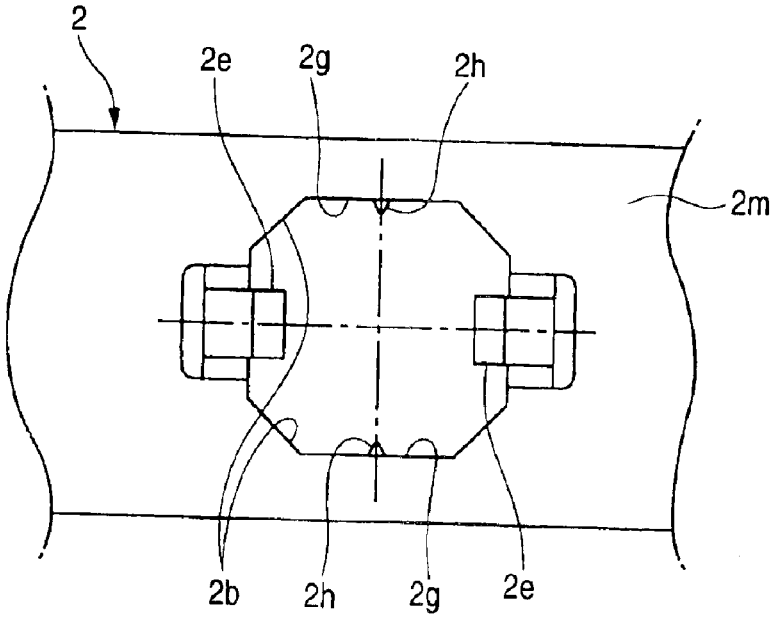
FIG. 5 is a plan view of a part of a board body showing an opening shape of a nut chamber.

As shown in FIG. 5, the other pair of inner walls 2*g* of the nut chamber 2*a* which are opposed to each other are formed with minute linear projections 2*h* each having, for example, a width of about 0.15 mm, and a length of about 0.5 mm in an axial direction of the nut chamber 2*a*. The linear projections 2*h* are formed at least higher than the flat faces 2*k* of the engaging projections 2*f*, and so designed as to be contacted with side faces of the square nut 3 which will be described later.

Figure 10:
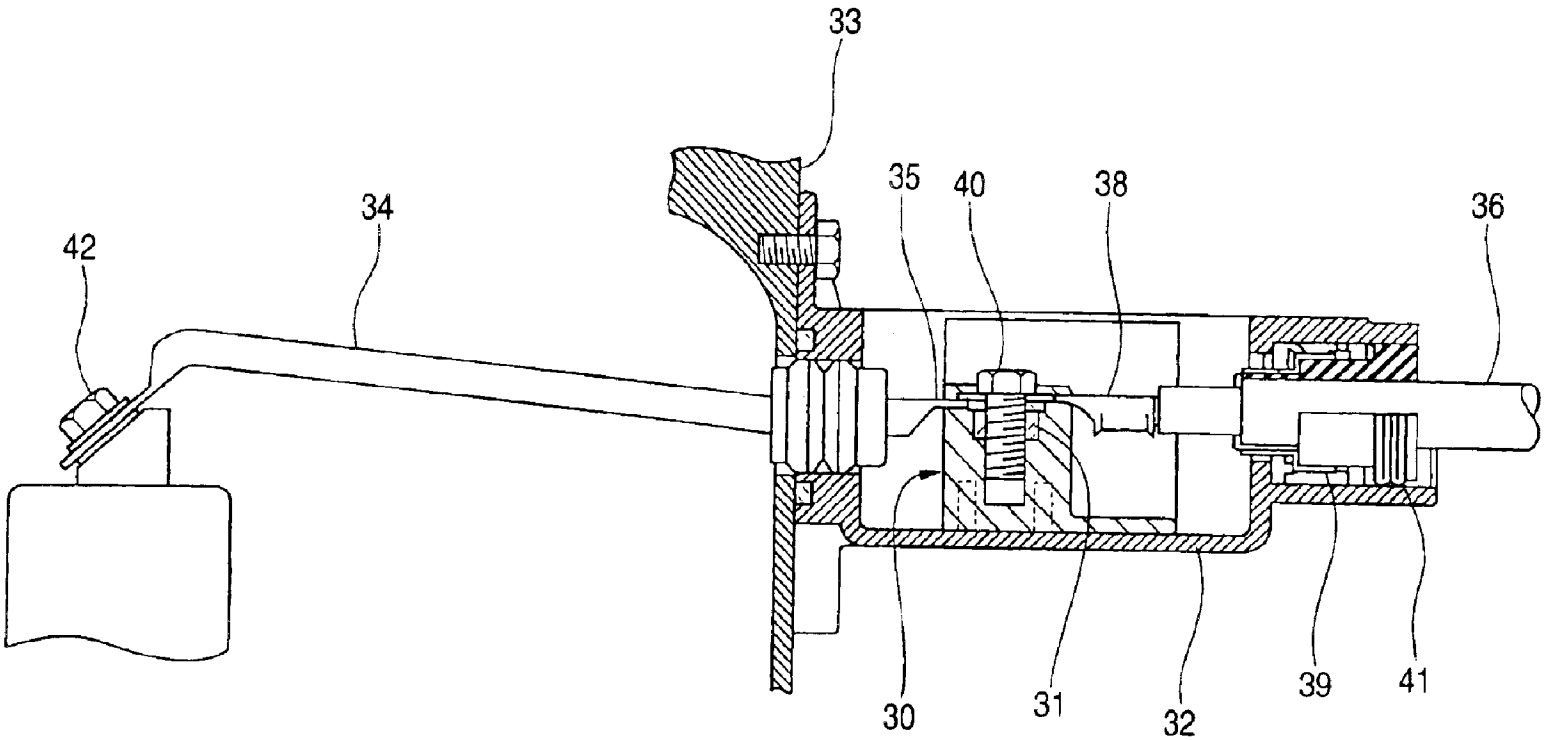
FIG. 10 is a vertical section view showing a related-art terminal board.
Figure 11:
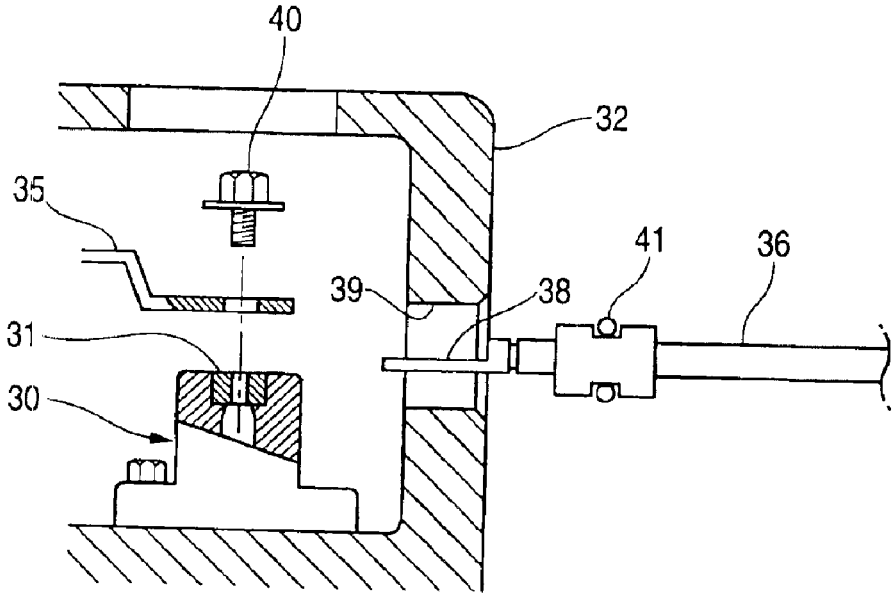
FIG. 11 is an enlarged vertical section view showing an essential portion of the terminal board of FIG. 10.
Figure 12:
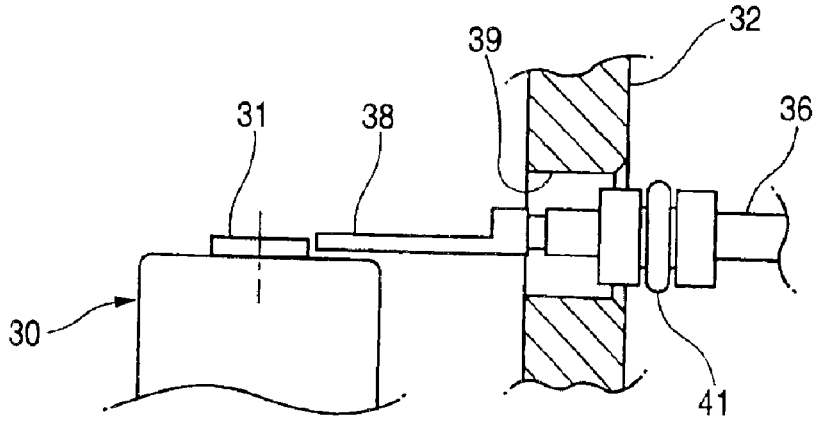
FIGS. 12 to 14 are vertical section views for explaining problematic conditions occurred in relation with the terminal board of FIG. 10.
Figure 13:
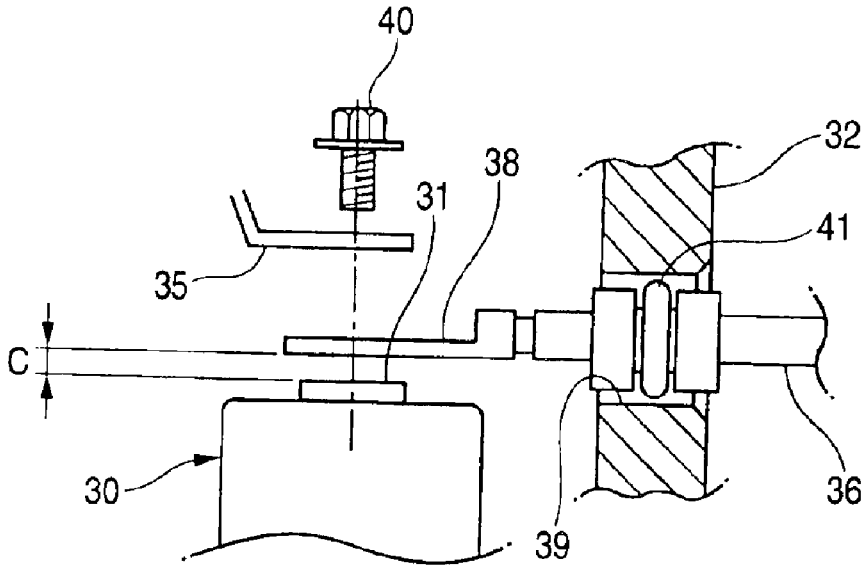
Figure 14:
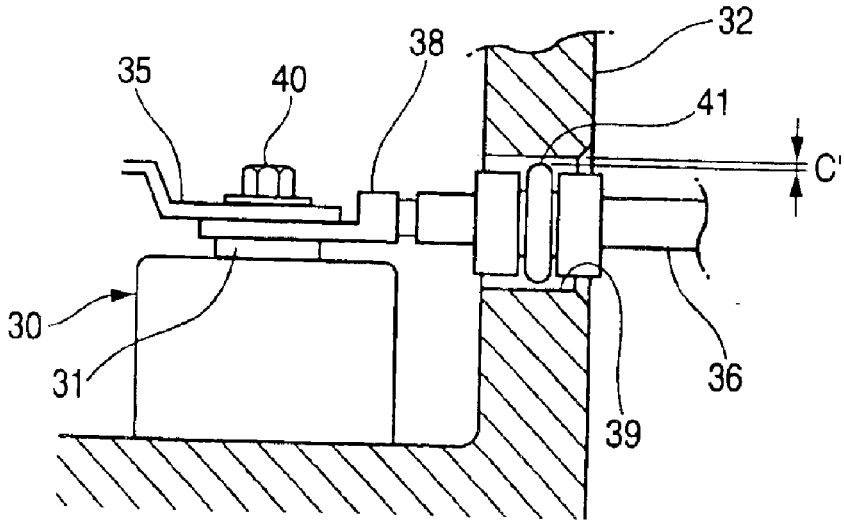
Figure 15:
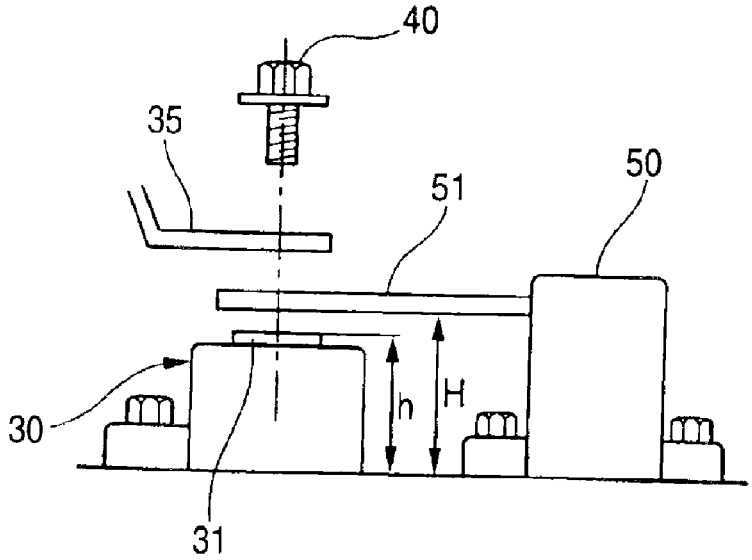
FIG. 15 is a vertical section view for explaining a problematic condition occurred in relation with another related-art terminal board.

As shown in FIG. 1, two mounting members 2*j* having through holes 2*i* are integrally formed on a side part of the board body 2, and collars 4 are embedded in the through holes 2*i* by insert molding, so that bolts which are not shown may be inserted into the collars 4 for enabling the board body to be fixed to a shield case 32 (see FIG. 10), for example.

As shown in FIG. 2, the square nut 3 is a nut having a square shape in an outer appearance and provided with a female screw 3*a*. Four corners of the square nut 3 are chamfered at 45 degrees in their upper half parts to be formed in an octagonal shape. The octagonal shape is the same as the shape of the opening which is formed at the upper end of the nut chamber 2*a*. The lower half parts of the four corners of the square nut 3 are not chamfered and remain as projected portions 3*b*.

As shown in FIG. 3, the square nut 3 is inserted into the nut chamber 2*a* from the top octagonal face thereof in a direction of an arrow A. The square nut 3 is further inserted while spreading the pair of lances 2*e* against their elasticity in the width direction of the nut chamber 2*a*, and ride over the engaging projections 2*f*. In this manner, the projected portions 3*b* of the square nut 3 are positioned between the flat faces 2*k* of the engaging projections 2*f* and the retainers 2*b*, and the square nut 3 will be prevented from falling from the nut chamber 2*a*, because the flat faces 2*k* of the engaging projections 2*f* in a lower part and the retainers 2*b* in an upper part are respectively abutted against the projected portions 3*b* as obstacles. A level of the flat faces 2*k* is so determined that when the square nut 3 is placed on the flat faces 2*k* of the engaging projections 2*f*, the top face (a contact face) 3*c* of the square nut 3 is made flush with an upper face 2*m* of the board body 2.

A distance between the flat faces 2*k* of the engaging projections 2*f* and the retainers 2*b* is larger than a thickness of the projected portions 3*b* of the square nut 3. In other words, a clearance 5 is formed in the nut chamber 2*a* for allowing the square nut 3 to move in the axial direction thereof inside the nut chamber 2*a*. The square nut 3 can move upwardly about 2 mm in the clearance 5, up to a position as shown by a dashed line in FIG. 3 where the upper faces of the projected portions 3*b* are abutted against the retainers 2*b*. On this occasion, the upper face 3*c* of the square nut 3 is adapted to protrude from the upper face 2*m* of the board body 2.

Figure 6:
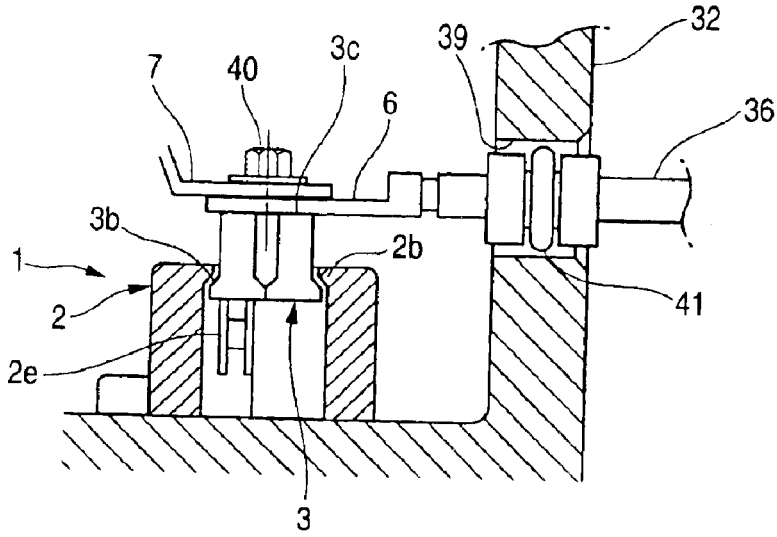
FIG. 6 is a vertical section view showing connecting portions fixed to the terminal board.

The terminal board 1 which has been assembled as described the above is fixed to the shield case 32 as shown in FIG. 6, by inserting the not-shown bolts into the collars 4. A motor cable 36 having a first connecting portion 6 fixed to its distal end is inserted through an insertion hole 39 of the shield case 32 to be faced with the square nut 3, and a second connecting portion 7 is superposed on the first connecting portion 6. Thereafter, a bolt 40 is inserted through the first and second connecting portions 6 and 7, and screwed into the square nut 3 to fasten them.

Here, even though a level of the first connecting portion 6 is not consistent with a level of the upper face 3*c* of the square nut 3, an undue force will not be exerted on the first connecting portion 6, because the square nut 3 moves upward in the clearance 5 along with rotation of the bolt 40, and the connecting portion 6 can be fastened without being distorted. Accordingly, a waterproof rubber plug 41 inserted over the motor cable 36 is tightly fitted to an inlet of the insertion hole 39 whereby a perfect water proof performance can be attained. Moreover, when the bolt 40 is fastened, undesired subsequent rotation of the square nut 3 will be hindered, because the square nut 3 is engaged in the nut chamber 2*a*, which serves as a rotation stopper.

Further, rattling of the squire nut 3 will be prevented, because the side faces of the square nut 3 are abutted against the linear projections 2*h* which are formed in the axial direction on the inner walls 2*g* of the nut chamber 2*a*. Therefore, occurrence of sounds of interference when the square nut 3 vibrates due to vibration in driving a vehicle and interferes with the inner walls 2*d* and 2*g* of the nut chamber 2*a* will be prevented. Still further, fastening strength of the bolt 40 with respect to the square nut 3 will not be decreased due to abnormal vibration of the square nut 3, and the connection between the first connecting portion 6 and the second connecting portion 7 can be maintained in good condition for a long time period and in a stable manner.

Figure 7A:
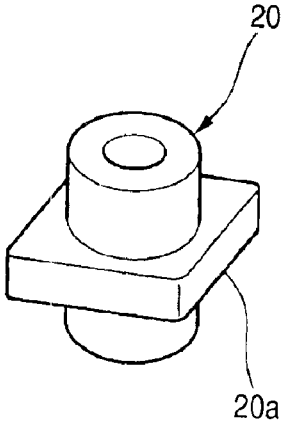
FIG. 7A is a perspective view of a nut according to a second embodiment of the invention.
Figure 7B:
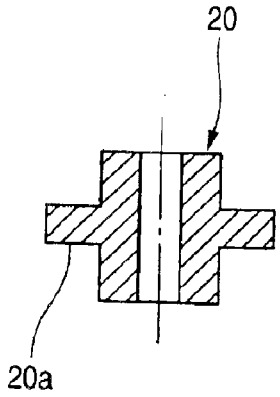
FIG. 7B is a vertical section view of the nut of FIG. 7A.

A nut 20 according to a second embodiment of the invention is shown in FIGS. 7A and 7B, which includes a flange-like projected portion 20*a* having a square shape is provided at a middle part of the nut 20 having a cylindrical shape. The nut 20 is inserted into the nut chamber 2*a* in the same manner as the square nut 3 in the first embodiment, and the projected portion 20*a* is forced to ride over the engaging projections 2*f* to be positioned between the engaging projections 2*f* and the retainers 2*b*. A distance between the engaging projections 2*f* and the retainers 2*b* is larger than a thickness of the projected portion 20*a*, and the clearance 5 is formed in the nut chamber 2*a*, as in the first embodiment, so that the nut 20 can move in the axial direction thereof inside the nut chamber 2*a*.

Figure 8:
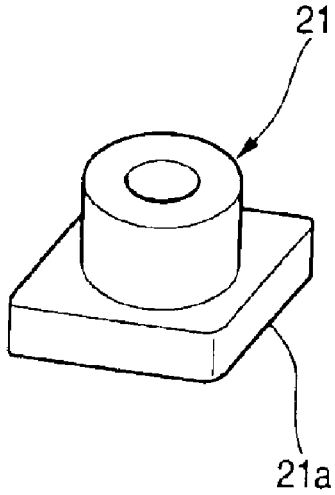
FIG. 8 is a perspective view of a nut according to a third embodiment of the invention.

A nut 21 according to a third embodiment of the invention is shown in FIG. 8, which includes a projected portion 21*a* having a square shape is provided at a lower end of the nut 21 having a cylindrical shape. The nut 21 acts in the exactly same manner as the nut 20 as shown in FIG. 7.

Figure 9:
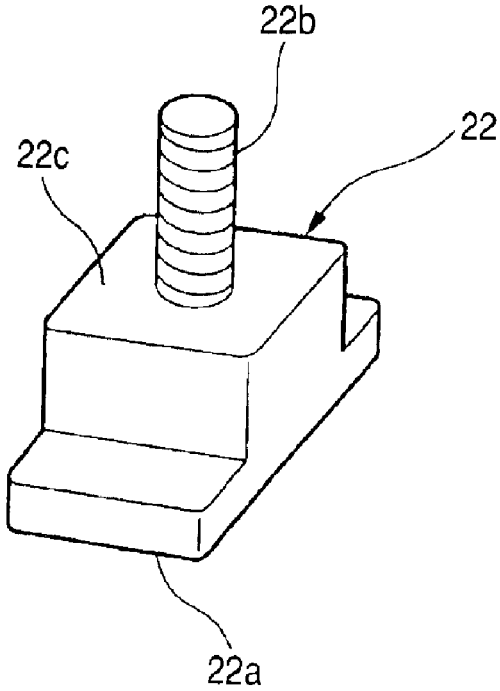
FIG. 9 is a perspective view of a bolt according to a fourth embodiment of the invention.

In a forth embodiment of the invention shown in FIG. 9, a bolt and a nut are arranged in an adverse manner. A bolt 22 having projected portions 22*a* which are laterally extended from a lower end of the head portion of the bolt 22. The bolt 22 is inserted into the nut chamber 2*a* from a male screw portion 22*b* so as to place the projected portions 22*a* between the engaging projections 2*f* and the retainers 2*b*. On this occasion, an upper face 22*c* of the head portion of the bolt 22 will be made flush with the upper face 2*m* of the board body 2. The bolt 22 acts in the exactly same manner as the above described nut. By contacting the first connecting portion 6 and the second connecting portion 7 with the upper face 22*c* of the head portion of the bolt 22, and fastening a nut (not shown) in screw fit, the first connecting portion 6 and the second connecting portion 7 will be electrically connected to each other.

It is to be noted that the present invention is not limited to the above described embodiments, but can be appropriately modified. Besides, material, shape, size, value, mode, number, position, etc. of constituent elements in the above described embodiments are optional, provided that they can achieve the invention, and are not limited.

Further, although the terminal board of the invention is described as such that a motor power source for an electric vehicle is adapted to be connected, the invention is not limited to this terminal board, but can be applied to terminal boards of other apparatuses.

What is claimed is:

1. A terminal board, at which a first connecting member of a power feeding side and a second connecting member of a power receiving side are electrically connected, the terminal board comprising:

a board body, including a chamber and an opening continued from the chamber; and a first fastening member, having a contact portion, and accommodated in the chamber to fasten the first connecting member and the second connecting member on the contact portion with a second fastening member along a fastening axis, the first fastening member being movable in the chamber in a first direction parallel to the fastening axis, so that the contact portion is capable of being projected from the opening in accordance with a fastening operation of the first connecting member and the second connecting member;

the first fastening member is formed with a projected portion extending in a second direction perpendicular to the fastening axis; and the chamber is formed with a first retainer that abuts against the projected portion to ensure that the first fastening member is maintained at least partially within the chamber.

2. A terminal board, at which a first connecting member of a power feeding side and a second connecting member of a power receiving side are electrically connected, the terminal board comprising:

a board body, formed with a chamber and an opening continued from the chamber; and a first fastening member, having a contact portion, and accommodated in the chamber to fasten the first connecting member and the second connecting member on the contact portion with a second fastening member along a fastening axis, the first fastening member being movable in the chamber in a first direction parallel to the fastening axis, so that the contact portion is capable of being projected from the opening in accordance with a fastening operation of the first connecting member and the second connecting member;

wherein:

the first fastening member is formed with a projected portion extending in a second direction perpendicular to the fastening axis;

the chamber is formed with a first retainer against which the projected portion abuts in a case where the first fastening member is located at a first end of the movement in the chamber, and a second retainer against which the projected portion abuts in a case where the first fastening member is located at a second end of the movement in the chamber; and wherein a distance in the first direction between the first retainer and the second retainer is larger than a thickness in the first direction of the projected portion.

3. The terminal board as set forth in claim 2, wherein the contact portion is movable such that the contact member is not projected from the opening when the first fastening member abuts against the second retainer.

4. The terminal board as set forth in claim 1, wherein a projection projected from an inner face of the chamber in the second direction and extended in the first direction is abutted against the first fastening member.

5. The terminal board as set forth in claim 1, wherein the chamber has such a cross section in the second direction as to prevent the first fastening member from rotating in accordance with the fastening operation.

6. The terminal board as set forth in claim 1, wherein the first fastening member is a nut member, and the second fastening member is a bolt member.

7. The terminal board as set forth in claim 1, wherein the first fastening member is a bolt member, and the second fastening member is a nut member.

* * * * *